US009291993B2

(12) United States Patent
Sawashima

(10) Patent No.: US 9,291,993 B2
(45) Date of Patent: Mar. 22, 2016

(54) DRIVE TRANSMISSION MECHANISM AND IMAGE FORMING APPARATUS PROVIDED WITH THE SAME

(71) Applicant: CANON KABUSHIKI KAISHA, Tokyo (JP)

(72) Inventor: Fumiya Sawashima, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/565,958

(22) Filed: Dec. 10, 2014

(65) Prior Publication Data

US 2015/0160608 A1 Jun. 11, 2015

(30) Foreign Application Priority Data

Dec. 11, 2013 (JP) ..... 2013-255915

(51) Int. Cl.
*G03G 15/00* (2006.01)
*G03G 21/18* (2006.01)

(52) U.S. Cl.
CPC ..... *G03G 21/186* (2013.01)

(58) Field of Classification Search
CPC ..... G03G 21/186
USPC ..... 399/167
See application file for complete search history.

(56) References Cited

U.S. PATENT DOCUMENTS 8,270,877 B2 * 9/2012 Tomatsu ..... G03G 21/1623 399/167
8,571,445 B2 10/2013 Komatsu et al.
2003/0059233 A1 * 3/2003 Jang ..... G03G 15/757 399/167
2008/0226345 A1 * 9/2008 Yoon ..... G03G 21/1676 399/167
2011/0058851 A1 * 3/2011 Okabe ..... G03G 21/186 399/167
2011/0318054 A1 * 12/2011 Fukuzawa ..... G03G 15/757 399/167
2013/0302066 A1 * 11/2013 Kawai ..... G03G 15/50 399/167
2014/0112685 A1 4/2014 Komatsu et al.

FOREIGN PATENT DOCUMENTS

JP 2010-262056 A 11/2010

* cited by examiner

*Primary Examiner* — Susan Lee
(74) *Attorney, Agent, or Firm* — Fitzpatrick, Cella, Harper & Scinto

(57) ABSTRACT

A drive transmission mechanism includes a driving coupling element having a first engaging portion and a first operating portion; and a holder having a second engaging portion and a second operating portion, wherein when the first and second engaging portion are engaged, the driving coupling element is held in a middle position to be prevented from moving therefrom to a projected position. When the driving coupling element is moved from the middle position toward a retracted position, the first and second operating portions contact each other so that the driving coupling element rotates to a second angular position where they are disengaged from each other. By the driving coupling element rotating from the first angular position to the second angular position, the driving coupling element is enabled to move to the projected position.

19 Claims, 11 Drawing Sheets

DRIVE TRANSMISSION MECHANISM AND IMAGE FORMING APPARATUS PROVIDED WITH THE SAME

FIELD OF THE INVENTION AND RELATED ART

The present invention relates to a drive transmission mechanism for transmitting a rotational force from a driving device to a driven side, the drive transmission mechanism being suitable for use in a drive transmission coupling the driving force from a main assembly side of the apparatus to a cartridge of cartridge type image forming apparatus, for example. In addition, the present invention relates to an image forming apparatus provided with such a drive transmission mechanism.

Japanese Laid-open Patent Application 2010-262056 discloses the following structure as a coupling structure of a drive transmitting portion for drive transmission from the main assembly side of the image forming apparatus to the process cartridge. By opening and closing operations of a main assembly cover provided on a main assembly A, a coupling member of the main assembly side of the apparatus is retracted in the rotational axis direction.

The present invention provides a further improvement to such a prior-art. It is another object of the present invention to provide a drive transmission mechanism having easy assembling property and an image forming apparatus provided with the same.

SUMMARY OF THE INVENTION

According to an aspect of the present invention, there is provided a drive transmission mechanism comprising a driving side coupling member for transmitting a rotational force; a holder member for holding said driving side coupling member; said driving side coupling member being provided with a first engaging portion; said holder member being provided with a second engaging portion which is capable of engaging with said first engaging portion when said driving side coupling member is in a first rotation angular position relative to said holder member; said driving side coupling member being further provided with a first operating portion; and said holder member being further provided with a second operating portion for rotating said driving side coupling member when contacting to said first operating portion, and said driving side coupling member being movable along a rotational axial direction thereof between (1) a projected position projected from said holder member, (2) a retracted position retracted toward said holder member and (3) a middle position between the projected position and the retracted position, wherein when said first engaging portion and said second engaging portion are engaged with each other, said driving side coupling member is held in the middle position to be prevented from moving from the middle position to the projected position, wherein when said driving side coupling member is moved from the middle position toward the retracted position, the first operating portion and the second operating portion contact to each other so that said driving side coupling member rotates relative to said holder member to a second rotation angular position where said first engaging portion and said second engaging portion are disengaged from each other, and wherein by said driving side coupling member rotating from the first rotation angular position to the second rotation angular position, said driving side coupling member is enabled to move to the projected position.

Further features of the present invention will become apparent from the following description of exemplary embodiments with reference to the attached drawings.

DESCRIPTION OF THE EMBODIMENTS (General Arrangement of Image Forming Apparatus)

Figure 1:
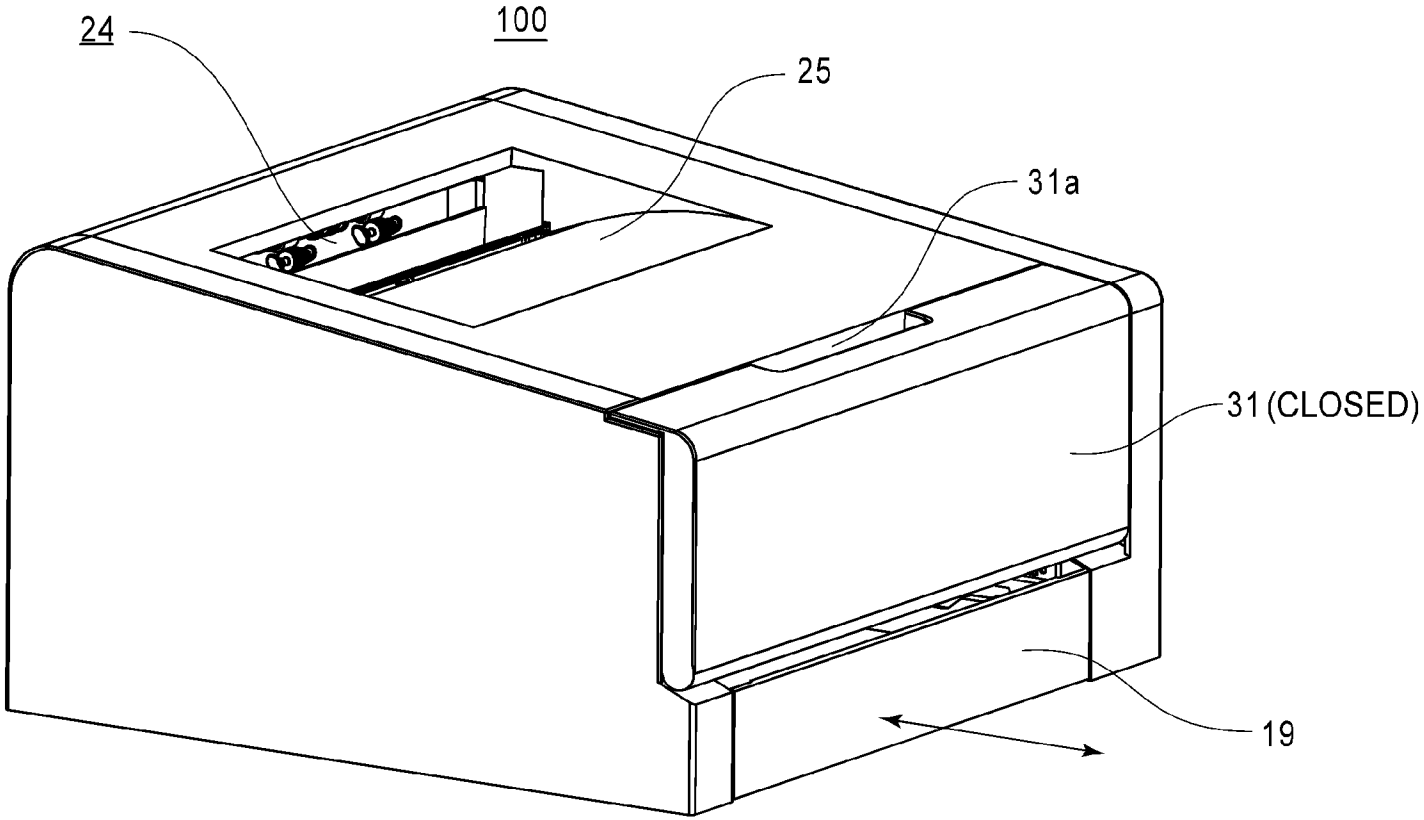
FIG. 1 is a perspective view of an outer appearance of the image forming apparatus according to an embodiment of the present invention.
Figure 2:
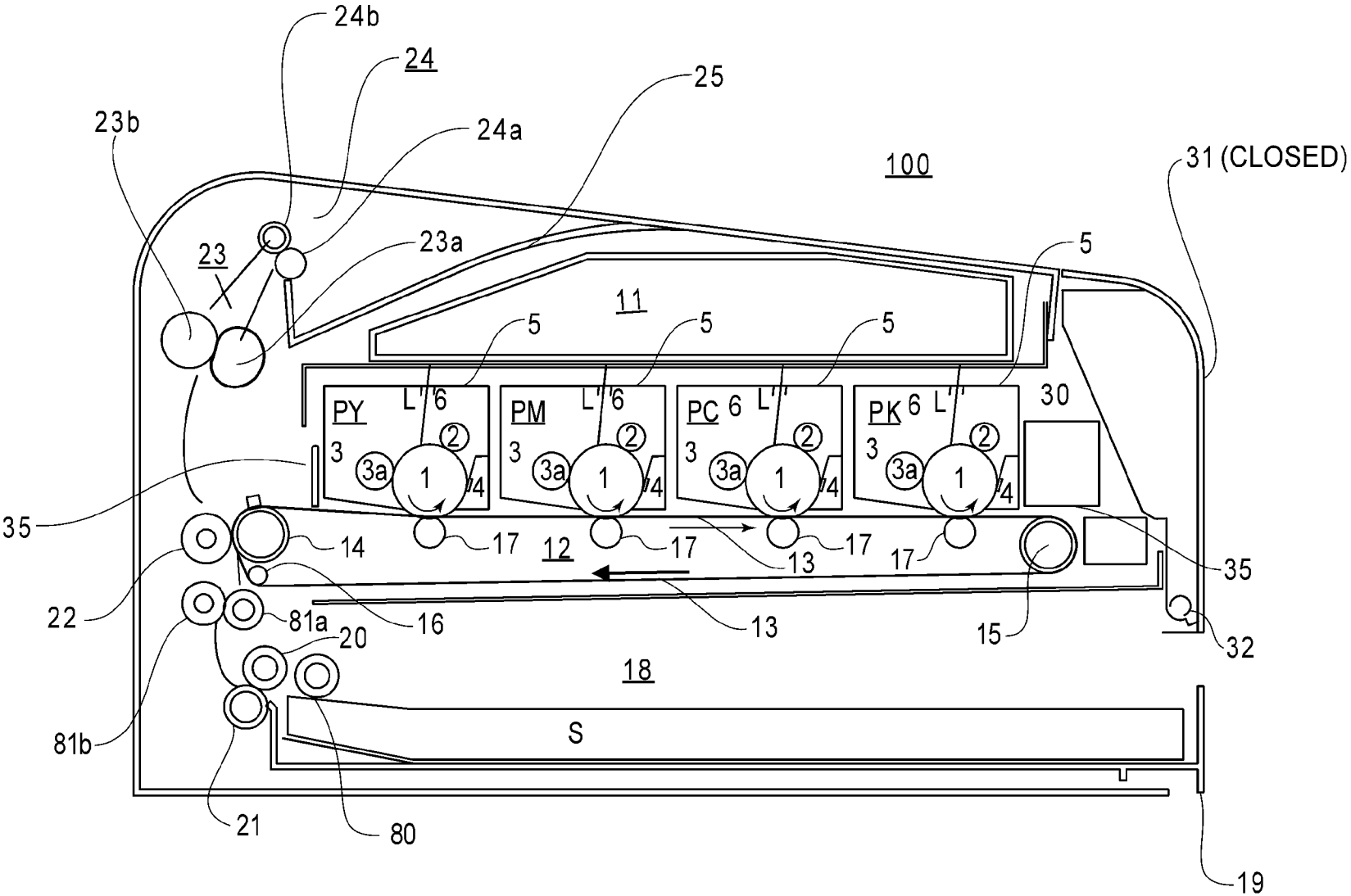
FIG. 2 is a longitudinal left-hand side schematic view of the image forming apparatus.

FIG. 1 is a perspective view of an outer appearance of an image forming apparatus 100 according to an embodiment of the present invention, and FIG. 2 is a longitudinal left-hand surface schematic view. The image forming apparatus 100 is a four full-color laser beam printer of the cartridge type using an electrophotographic process. The image forming apparatus forms an image on a recording material (sheet) S in accordance with an electrical image signal supplied into a control circuit portion (unshown) from the host apparatus (unshown) such as a personal computer, an image reader, or a sender part of a facsimile machine.

In the following description, a front side of the image forming apparatus (main assembly A) is a side provided with an apparatus door (openable member) 31 as a main assembly cover. The rear side is an opposite side. The front and rear directions are the direction from the rear side toward the front side of the main assembly A (frontward direction), and a direction opposite therefrom (backward direction). Left and right are left-hand and right-hand, respectively when the apparatus is seen from the front side. Left-right directions are the directions from the right side toward the left side (leftward direction), and the direction opposite therefrom (rightward direction).

Referring to FIG. 2, in the main assembly A, there are provided first to fourth cartridges P (PY, PM, PC, PK) arranged substantially in the horizontal direction, from the rear side to the front side (in-line structure one tandem type). The cartridges P have the same structures except that the colors of the toner particles accommodating therein are different.

Each cartridge P in this embodiment is a so-called integral type process cartridge. More particularly, each of the cartridges comprises an electrophotographic photosensitive drum as a first image bearing member, and process means actable on the drum 1 (charger 2, developing device 3 and a cleaning device 4), which are provided integrally in a cartridge frame 5. The charger 2 is a contact type charging roller in this embodiment. The developing device 3 includes a developing roller (developing member) 3*a*, and the developer (toner) is accommodated in the developer container. The cleaning device 4 is a blade equation device in this embodiment.

The first cartridge PY includes the developing device 3 containing yellow (Y) toner to form a yellow (Y) chromatic toner image on the drum 1. The second cartridge PM includes the developing device 3 containing magenta (M) to form a magenta (M) chromatic toner image on the surface of the drum 1. The third cartridge PC includes the developing device 3 containing cyan (C) chromatic toner to form a cyan (C) toner image on the drum 1. The fourth cartridge PK includes the developing device 3 containing black (K) toner to form a black (K) chromatic toner image on the drum 1.

Above the cartridges PY, PM, PC, PK, there is provided a laser scanner unit 11. The scanner unit 11 produces a laser beam L modulated in accordance with image information of each color supplied from an external host apparatus and scanningly projects the laser beam onto the surface of the drum 1 of the cartridge P through the exposure window 6 provided on the top side of the cartridge frame 5.

Below the cartridges PY, PM, PC, PK, there is provided an intermediary transfer belt unit 12. The belt unit 12 functions as an intermediary transfer member (second image bearing member) and includes an endless flexible intermediary transfer belt 13 made of dielectric member, and a driving roller 14, a tension roller 15 and a turning roller 16 which stretch and rotate the belt 13. The driving roller 14 and the turning roller 16 are disposed in a rear side of the main assembly A. The tension roller 15 is disposed in the front side of the main assembly.

Lower surfaces of the drums 1 of the cartridges P are in contact with an upper traveling side of the belt 13. Inside the belt 13, there are provided four primary transfer rollers 17 opposed to the drums 1 of the respective cartridges P through the upper traveling side of the belt. To the driving roller 14, a secondary transfer roller 22 is urged with the belt 13 sandwiched therebetween.

Below the belt unit 12, a sheet feeding unit 18 is provided. The sheet feeding unit 18 comprises a sheet feeding tray 19, a sheet feeding roller 80, a feeding roller 20 and a separation roller 21. The sheet feeding tray 19 is loadable from the front side of the main assembly (front loading).

In an upper portion of the rear side in the main assembly, there are provided a fixing device 23 and a pair of sheet discharging rollers 24. The top surface of the main assembly functions as a sheet discharge tray 25. The fixing device 23 includes a fixing film assembly 23*a* and a pressing roller 23*b*. The pair of sheet discharging rollers 24 comprises a sheet discharge roller 24*a* and a sheet discharging roller 24*b*.

Each cartridge P mounted to the mounting position in the main assembly is fixed at the predetermined position. A drive inputting portion of the cartridge P which will be described hereinafter is coupled with a drive outputting portion of the main assembly which will be described hereinafter. By this arrangement, a driving force (rotational force) can be transmitted from a driving device (unshown) of the main assembly to each cartridge P. The cartridge P is provided with an electrical contact (unshown) which is connected with an electric energy supply line (unshown) of the main assembly. By this, predetermined bias voltages such as a charging bias voltage or developing bias voltage can be applied to each cartridge P from the voltage source device (unshown) of the main assembly.

The operation for forming a full-color image is as follows. The drums 1 of the first-fourth cartridges PY, PM, PC, PK are rotated at the predetermined control timing in the counterclockwise direction indicated by the arrow at a predetermined control speed. In addition, the developing rollers 3*a* and so on of the cartridges P are also rotated. The belt 13 is rotated in the clockwise direction indicated by the arrow at a predetermined speed corresponding to the speed of the drum 1. Also, the scanner unit 11 is driven.

In synchronism with the driving, the charging rollers 2 charge the surfaces of the drums 1 of the cartridges P at the respective predetermined control timings. The scanner unit 11 scans the surfaces of the drums 1 with the laser beams L modulated in accordance with respective color image signals. By doing so, electrostatic latent images are formed on the surfaces of the respective drums 1 in accordance with the respective color image signals. The electrostatic latent images thus formed are developed into toner images by the respective developing devices 3.

By the above-described electrophotographic image forming process operations, a Y color toner image corresponding to a yellow component of the full-color image is formed on the drum 1 of the first cartridge PY, and the toner image is primary-transferred onto the belt 13.

An M color toner image corresponding to a magenta component of the full-color image is formed on the drum 1 of the second cartridge PM, and the toner image is primary-transferred onto the belt 13 superimposedly on the Y color toner image.

A C color toner image corresponding to a cyan component of the full-color image is formed on the drum 1 of the third cartridge PC, and the toner image is primary-transferred onto the belt 13 superimposedly on the Y+M color toner image.

A K color toner image corresponding to a black component of the full-color image is formed on the drum 1 of the fourth cartridge PK, and the toner image is primary-transferred onto the belt 13 superimposedly on the Y+M+C color toner image.

In this manner, unfixed four full-color toner image (Y+M+C+K) is formed synthetically on the belt 13. In each of the cartridges P, untransferred toner remaining on the surface of the drum 1 after the primary-image transfer of the toner image onto the belt 13 is removed by the cleaning device 4.

On the other hand, the sheet feeding rollers 80 are operated at a predetermined control timing. By this, a sheet S (recording material) of the sheets S stacked on the sheet feeding tray 19 is separated and fed out to a nip (secondary transfer nip) between the secondary transfer roller 22 and in the belt 13 by the feeding roller 20, the separation roller 21 and pairs 81*a*, 81*b* of the feeding rollers. And, the sheet S is nipped and fed by the nip, during which four color superimposing toner image is sequentially transferred onto a surface of the sheet S from the belt 13.

The sheet S is separated from the surface of the belt 13 and is introduced into the fixing device 23, and is pressed and heated by a fixing nip. In this manner, the color mixture of the toner images and the fixing thereof on the sheet are effected. Then, the sheet S is discharged from the fixing device 23 onto the sheet discharge tray 25 by the sheet discharging roller pair 24 as a full-color print. Secondary-untransferred toner remaining on the surface of the belt 13 after the separation of the sheet therefrom are electrostatically attracted onto the surface of the drum 1 at the primary transfer portion of the first process cartridge PY, for example, in this embodiment, and is removed by the cleaning device 4.

(Cartridge Exchanging Type)

In the image forming apparatus 100 of this embodiment, the four cartridges PY, PM, PC, PK are carried on a drawer type tray 35 and can be changed at the front side of the apparatus (front access), for improvement of usability. The exchanging type is known, and therefore, will be described briefly.

Figure 3:
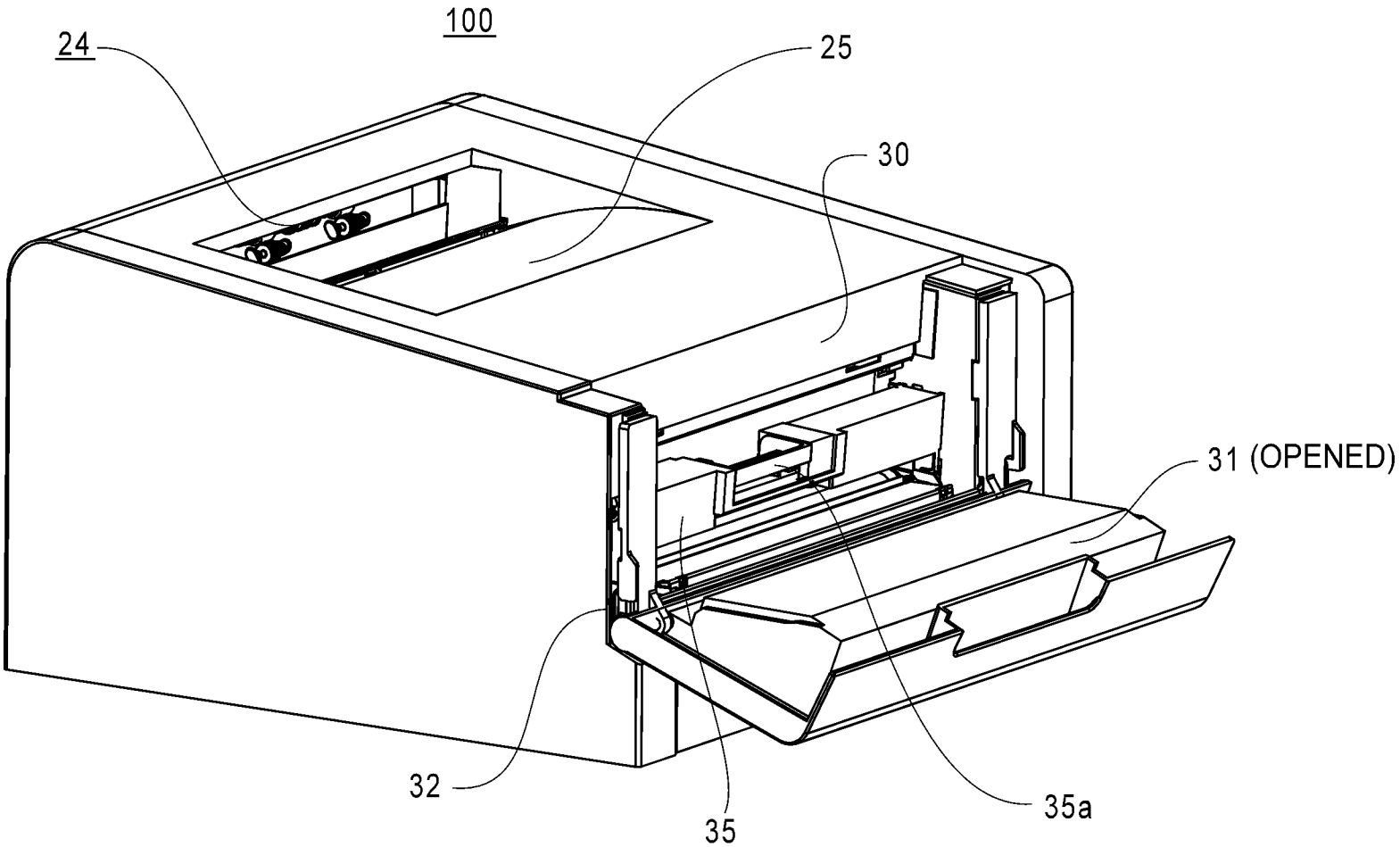
FIG. 3 is a perspective view of an outer appearance of the image forming apparatus when a door is open.

As shown in FIGS. 1 and 2, in the exchange of the cartridge P, a door 31 as a main assembly cover provided in the front side of the main assembly is opened by rotating it toward the front side about the hinge shaft 32 sufficiently, as shown in FIG. 3. Then, the front side opening 30 of the main assembly is opened.

The door 31 is movable between a closed state for closing the opening 30 and an opened state for opening the opening 30. The opening is provided for the purpose of permitting demounting and dismounting of the cartridge P, exchange of the intermediary transfer belt unit 12, jam paper clearance operation and so on.

By the operation of the interrelating mechanism (unshown) in interrelation with a moving operation of the door 31 from the closing position to the opening position, the coupling between the drive outputting portions of the main assembly and the drive inputting portions of the cartridges P is broken. In addition, the electrical conduction between the electric energy supply line of the main assembly and the electrical contacts of the cartridges P is disconnected. Furthermore, the positioning urging of the cartridges P to the main assembly is released.

Then, a tray grip portion 35*a* in the opening 30 is gripped, and the tray 35 is drawn out to the front side. By gripping the grip portion 35*a*, the locking of the tray 35 relative to the main assembly A is released, and the tray 35 is drawn out through the opening 30. The tray 35 is supported substantially horizontally by a guiding member (unshown) extending in the front-rear direction in the main assembly so as to be movable between the inside and outside of the main assembly.

Figure 4:
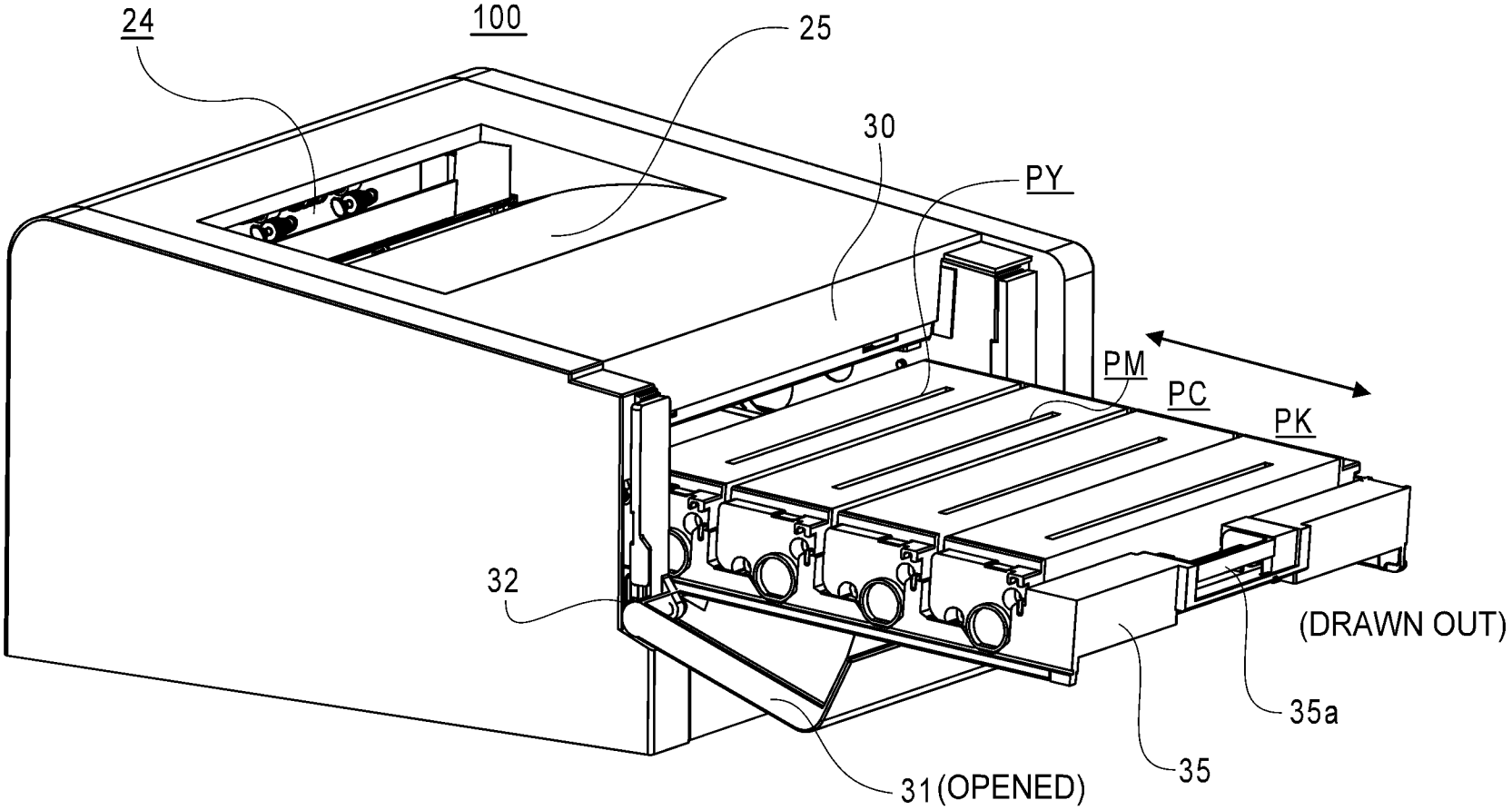
FIG. 4 is a perspective view of an outer appearance of the image forming apparatus when the cartridge is exchanged.

When the tray 35 is drawn out sufficiently to a predetermined extent, a further drawing in the outward direction is prevented by a stopper member (unshown). In the state, all of the cartridges PY, PM, PC, PK supported and arranged along the moving direction of the tray 35 are exposed outside (FIG. 4). In this state, the cartridges P on the tray 35 can be replaced with fresh cartridges, respectively.

After the completion of the replacement, the tray 35 is inserted back into the main assembly (from the state of FIG. 4 to the state of FIG. 3). When the tray 35 is pushed back into the main assembly to a sufficient extent, the tray 35 is locked by the main assembly. Then, the door 31 is closed to close the opening 30 (FIGS. 1 and 2).

By the operation of the interrelating mechanism (unshown) interrelated with the moving operation of the door 31 from the opening position to the closing position, the cartridge P is urged and positioned to the main assembly. In addition, the connection between the drive outputting portions of the main assembly and the drive inputting portions of the cartridges P is established. In addition and the electrical conduction between the electric energy supply line of the main assembly and in the electrical contact of the cartridges P is established. By doing so, the image forming apparatus 100 is reset into the state capable of the image forming operation.

(Drive Transmission Mechanism)

At the driven sides of the cartridges P mounted and positioned in the mounting position in the main assembly, driving forces (rotational forces) of the motor (driving device) of the main assembly can be transmitted through the drive transmission mechanism to the drums 1 and the developing rollers 3*a*, respectively.

As will be described hereinafter, a driving side of the coupling (drive inputting portion) is provided in the cartridge P. On the other hand, a driving unit (drive outputting portion), of the drive transmission mechanism, which includes a driving side of the coupling capable of engaging with and disengaging from the driven side of the coupling is provided in the main assembly of the apparatus.

In addition, as to the driving roller 14 for rotating the intermediary transfer belt 13, a driving force is transmitted from the motor of the main assembly A to a driving roller driven side coupling provided at one end portion side of the driving roller 14 through a reduction gear train (unshown). The belt 13 is contacted with the surface of the drum 1, and during the image forming operation, the surface of the drum 1 and the surface of the belt 13 move in the same direction substantially at the same speed at the contact portion therebetween.

Here, in the image forming apparatus (main assembly) 100 of this embodiment, the longitudinal direction is the direction substantially parallel with the rotational axis directions of the rotatable members such as the rotatable image bearing member or the rotatable developer carrying member. A widthwise direction is a direction substantially perpendicular to the longitudinal direction. One end portion side in the longitudinal direction is the driving side, and the other end portion side is the non-driving side. In this embodiment, the right-hand end side with respect to the longitudinal direction is the driving side and the left-hand end side is the non-driving side.

Figure 5:
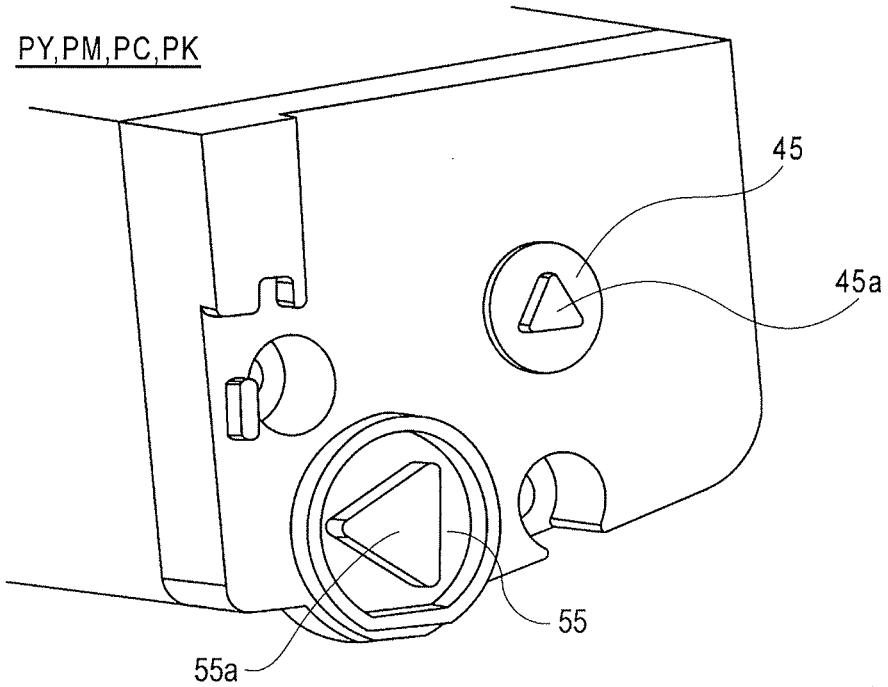
FIG. 5 is a perspective view of an outer appearance of a drive side portion of the cartridge.

As shown in FIG. 5, an end surface of the cartridge P at the one end portion side of (driving side) is provided with a drum driven side coupling 55 as a driven side coupling member and a development driven side coupling 45. The driven side coupling members 55, 45 are provided with projections 55*a*, 45*a* having triangular shape cross-sections, respectively. Projections 55*a*, 45*a* are twisted about the axial direction.

Figure 6:
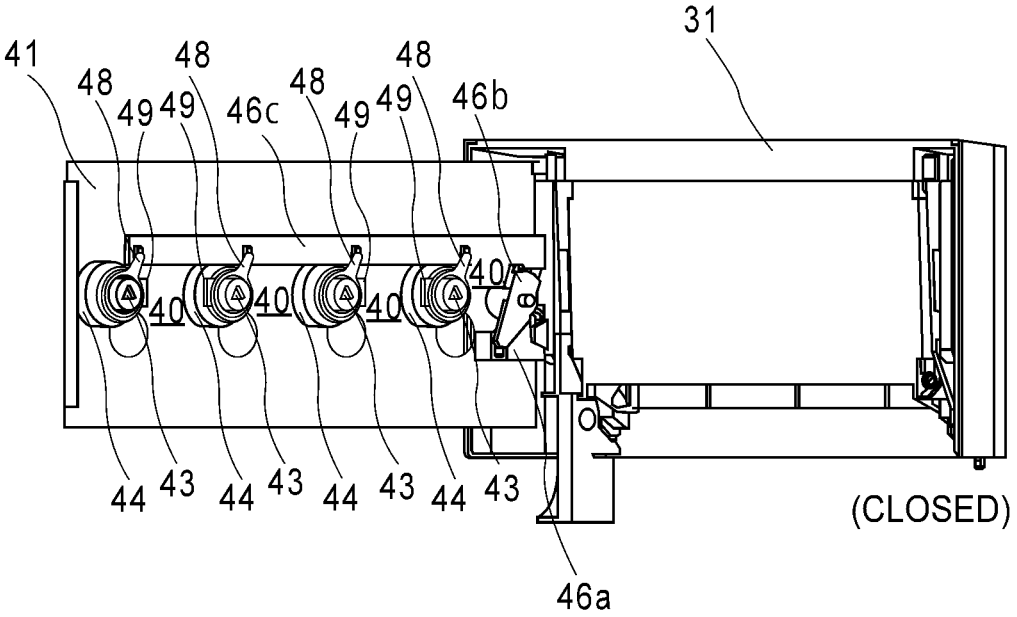
FIG. 6 is a perspective view of the image forming apparatus illustrating structures of a link mechanism and the coupling when the door is closed.
Figure 7:
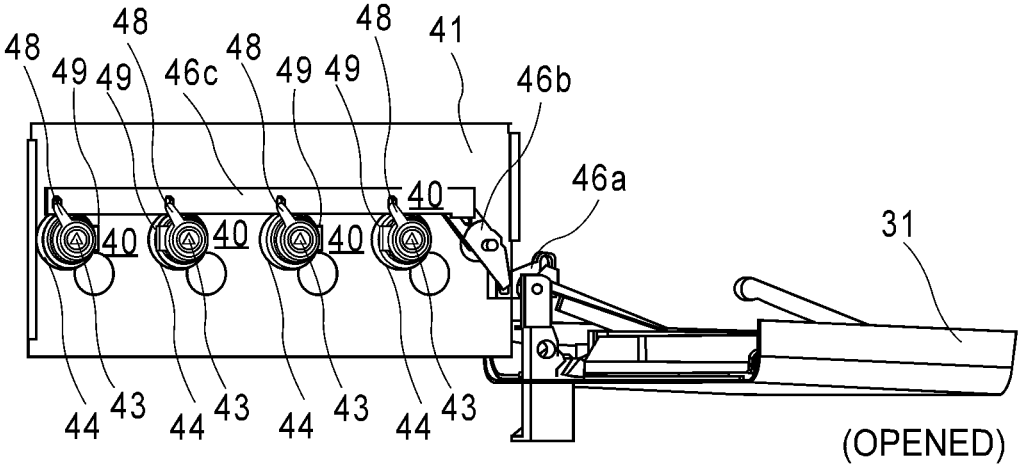
FIG. 7 is a perspective view of the image forming apparatus illustrating structures of the link mechanism and the coupling when the door is opened.

On the other hand, as shown in FIGS. 6 and 7, the driving side in the main assembly A is provided with a drum driving unit (50) and a development driving unit 40 for the drum driven side couplings 55 and the development driven side couplings 45 of the respective cartridges P.

In FIGS. 6, 7, for the purpose better showing, the drum driving units (50) are omitted, and only four development driving units 40 for the development driven side coupling 45 of the cartridges P are shown. The structures and the operation of the drum driving unit (50) are similar to those of the development driving unit 40, and in the development driving unit 40 is taken as a representative driving unit in the explanation.

The development driving unit 40 is provided with developing drive side coupling 43 as the driving side coupling member. The developing drive side coupling 43 has a recess 43*b* having a triangular shape cross-section, and a free end portion. The recess 43*b* is also twisted about the axis.

Figure 8:
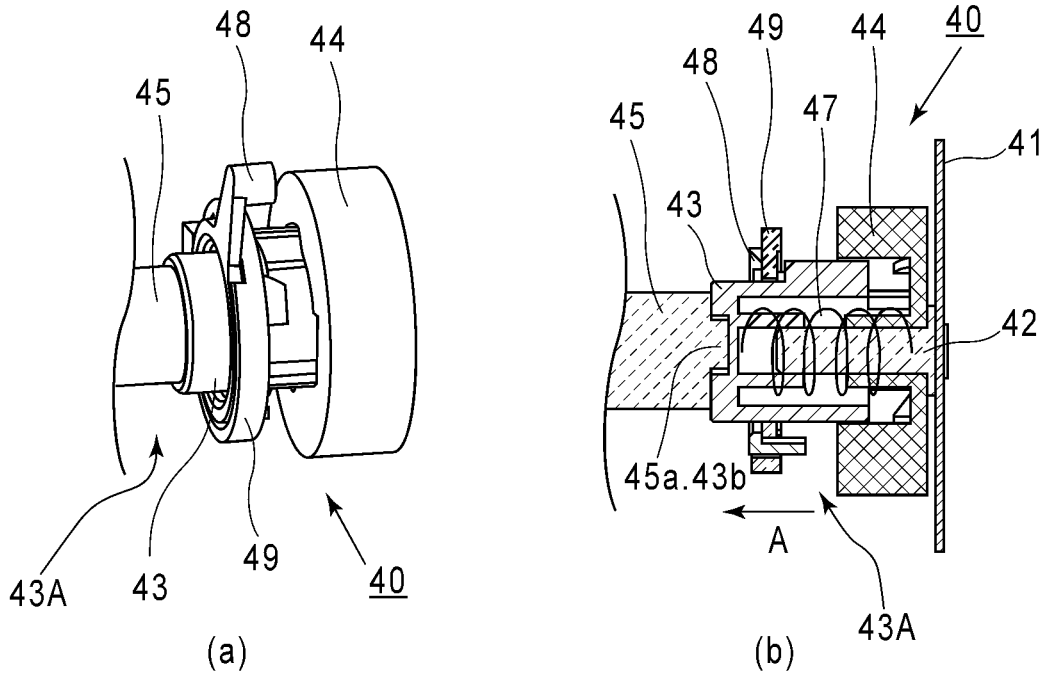
FIG. 8 is a perspective view of the image forming apparatus and a sectional view illustrating detailed structures of the coupling portion minute when the door is closed.

As will be described hereinafter, the developing drive side coupling 43 advances and retracts in the rotational axis direction in interrelation with the opening and closing operation of the opening and closing door 31. More particularly, when the door 31 is in the closed state, the developing drive side coupling 43 is in the advanced position in which it is projected from a coupling gear 44 of the development driving unit 40 toward the cartridge P, as shown in FIGS. 6, 8. The position of the developing drive side coupling (drive coupling member) 43 is called first position (projected position).

In this state, the developing drive side coupling 43 is coupled with the development driven side coupling 45 of the cartridge P situated and positioned in the mounting position of the main assembly, more particularly, the projection 45*a* and the recess 43*b* are engaged with each other.

And, by the developing drive side coupling 43 being driven, the development driven side coupling 45 receives the driving force (rotational force) through the engagement between the projection 45*a* and the recess 43*b*, and in addition a force is produced in the direction of attracting each other. To the developing roller 3*a*, the driving force is transmitted from the development driven side coupling 45 through the gear train in the cartridge P.

Figure 9:
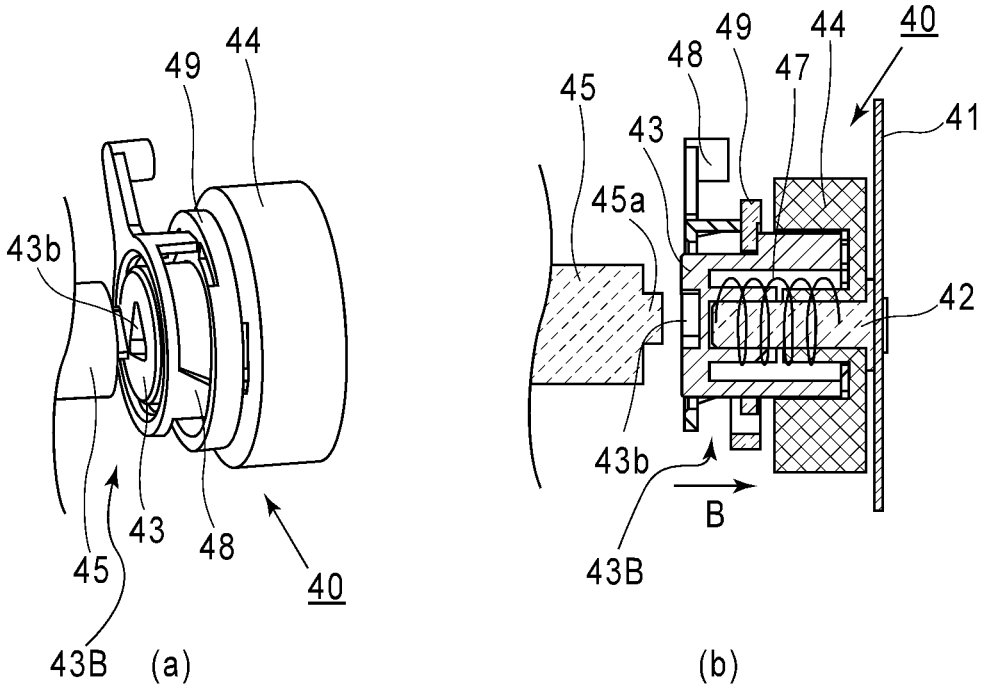
FIG. 9 is a perspective view of the image forming apparatus and a sectional view illustrating details of the coupling portion minute when the door is opened.

When the door 31 is in the opened state, the developing drive side coupling 43 is in the retracted position toward the inside of the development driving unit 40 (coupling gear 44), as shown in FIGS. 7 and 9. In this state, the developing drive side coupling 43 is out of engagement with the development driven side coupling 45 of the cartridge P and is therefore, disconnected from the cartridge P. The position of the developing drive side coupling (drive coupling member) 43 in this state is called a retracted position (second position).

The operations of the drum driving unit (50) of the main assembly relative to the drum driven coupling 55 of the cartridge P are similar to those of the development driving unit 40.

As regards the projection and the recess, the driving side coupling may be provided with a projection having a triangular shape section, and such a case, the driven side coupling is provided with a recess having a triangular shape section. The triangular configuration is not inevitable in the present invention, and it may be rectangular configuration, and a combination of parallel pins and grooves, a D-cut configuration keyway is usable.

(Detail Structure of the Development Driving Unit)

Figure 10:
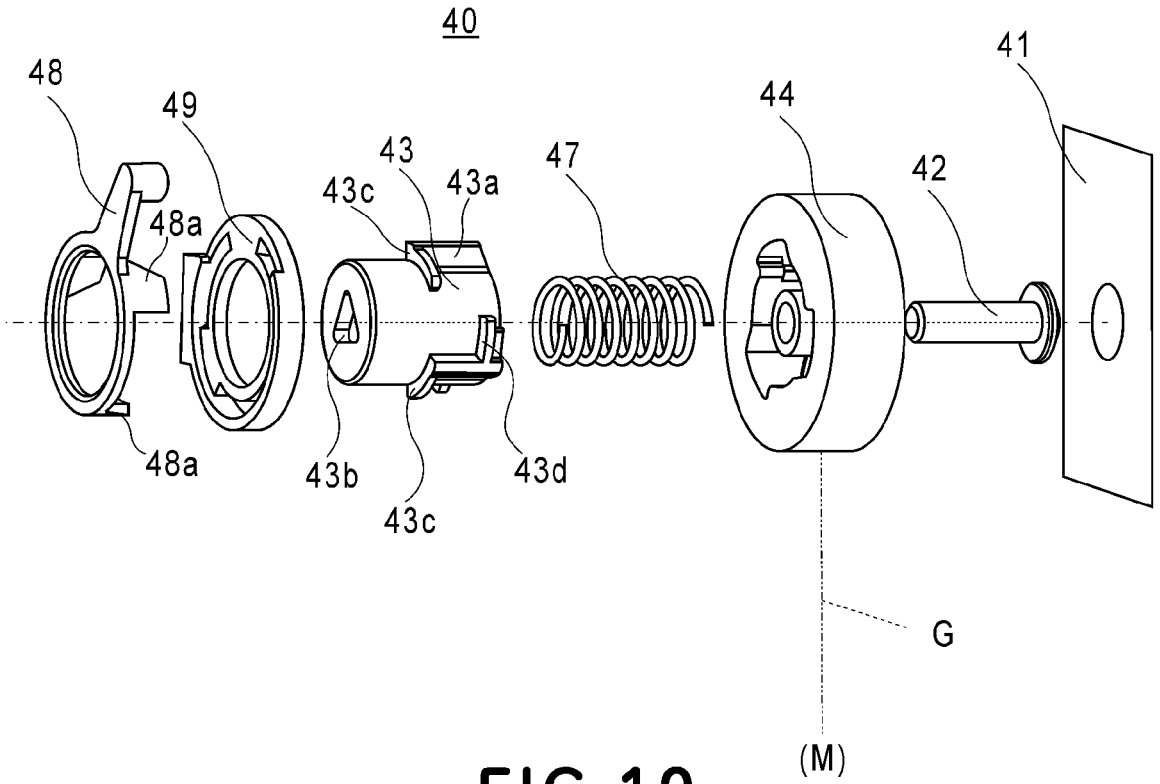
FIG. 10 is an exploded perspective view of a driving unit.

FIG. 10 is an exploded perspective view of the development driving unit 40. A driving shaft 42 is clamped on a drive plate 41 (FIGS. 6, 7) of the main assembly. The developing drive side coupling 43, a holder (coupling gear 44 in this embodiment) supporting the developing drive side coupling 43, a spring (elastic member) 47, a first spacing member (first retracting member) 48 and a second spacing member (second retracting member) 49 are provided substantially coaxially with one another. The spring 47 is an urging means for urging the developing drive side coupling 43 toward the developing driven side coupling 45 of the cartridge P.

Figure 11:
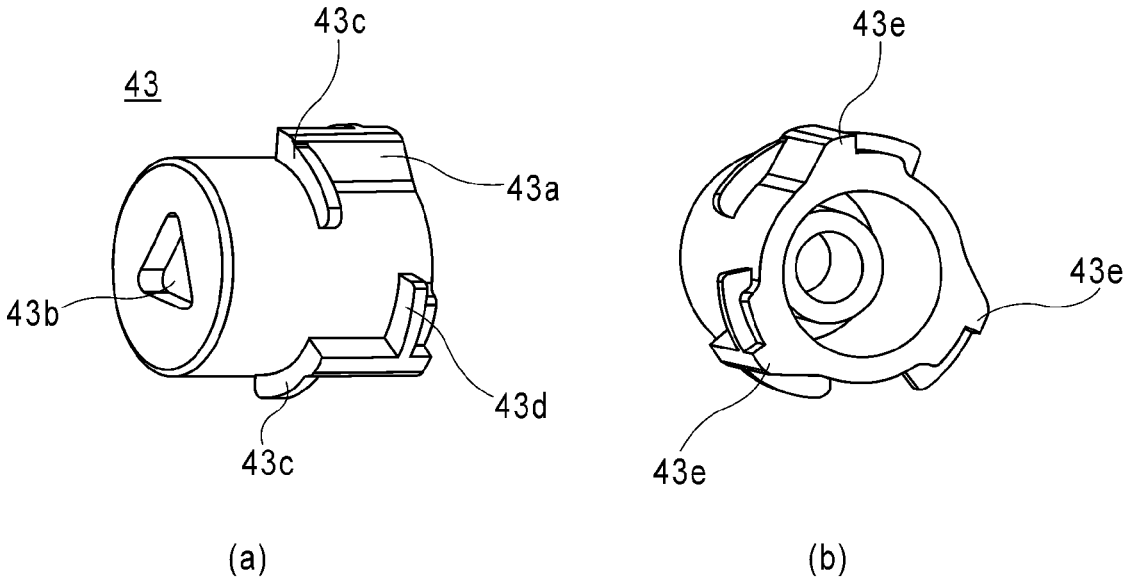
FIG. 11 is a perspective view of the coupling member of the driving unit.
Figure 12:
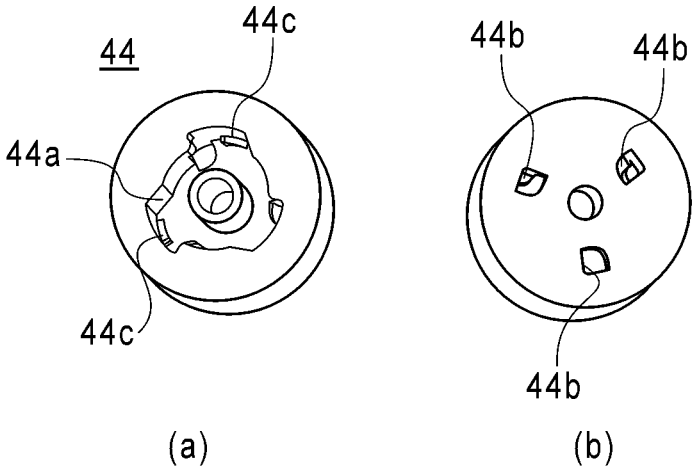
FIG. 12 is a perspective view of a holder member of the driving unit.
Figure 13:
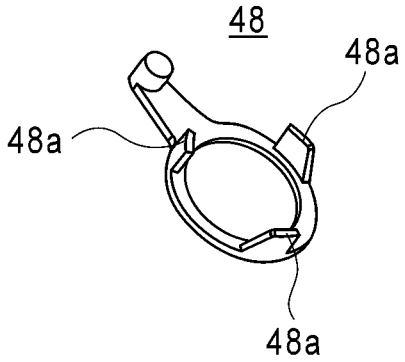
FIG. 13 is a perspective view of a first spacing member of the driving unit.
Figure 14:
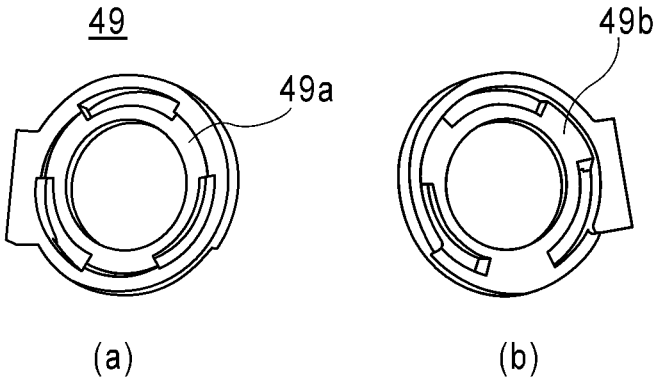
FIG. 14 is a perspective view of a second spacing member of the driving unit.

FIG. 11 is a detailed illustration of the developing drive side coupling 43, FIG. 12 is a detailed illustration of the coupling gear 44, FIG. 13 is a detailed illustration of a first spacing member 48, and FIG. 14 is a detailed illustration of a second spacing member 49.

The rotation from the motor (M) is used by a deceleration gear train (G), and is transmitted to the coupling gear 44 provided on the driving shaft 42 on the drive plate 41, so that the coupling gear 44 is rotated about the driving shaft 42. Then, the drive (rotational force) is transmitted from a surface (second transmitting portion, claw portion) 44*a* of the coupling gear 44 to a surface (first transmitting portion, claw portion) 43*a* of the developing drive side coupling 43. The developing drive side coupling 43 (drive coupling member) and the coupling gear 44 (holder member) are provided with claw portions 43*a*, 44*a* which are engaged with each other within a predetermined rotational angle range.

At this time, in this embodiment, the driving force is transmitted to each of three positions (three first transmitting portions 43*a* and three second transmitting portions 44*a*), but the number is not limiting to the present invention. The holder supporting the developing drive side coupling 43 may not be a gear, but a belt-drive or direct-drive structure is usable.

As shown in FIGS. 6, 7, the developing drive side coupling 43 is moved in the axial direction of the driving shaft 42 in interrelation with the opening and closing operation of the door 31 through links 46*a*-46*c*.

FIG. 6 shows the state in which the door 31 is closed. In this state, as described hereinbefore, the developing drive side coupling 43 is in the advanced position, as shown in FIG. 8, and is contacted with the development driven side coupling 45 (projected position (first position) 43A). In this state, the driving force can be transmitted from the motor (M) of the main assembly to the developing roller 3*a* of the cartridge P mounted and positioned in the mounting position in the main assembly of the apparatus.

More particularly, in the closed state of the door 31, the developing drive side coupling 43 is urged in the direction indicated by an arrow A (toward the developing drive side coupling 43 projected position) by the spring 47 provided between the coupling gear 44 and itself, as shown in part (a) and part (b) of FIG. 8. The developing drive side coupling 43 is engaged with the development driven side coupling 45 to transmit the driving force from the motor (M).

FIG. 7 shows the state in which the door 31 is open. In this state, as described hereinbefore, the developing drive side coupling 43 is in the retracted position and is disengaged from the development driven coupling 45 of the cartridge P, as shown in FIG. 9, that is, it is disconnected from the cartridge P.

As shown in part (a) and part (b) of FIG. 9, in interrelation with the movement of the door 31 from the closed state to the opening state, the first spacing member (first retracting member) 48 engaged with the main assembly frame (unshown) is operated through the links 46*a*-46*c*. A cam portion 48*a* of the first spacing member 48 presses against a first surface 49*a* of the second spacing member (second retracting member) 49.

By a second surface 49*b* of the second spacing member 49 urging a flange portion 43*c* of the developing drive side coupling 43, the developing drive side coupling 43 moves in the direction indicated by an arrow B (against the urging force of the spring 47), as shown in part (b) of FIG. 9. By this, the driving side coupling 43 moves to the release position (retracted position (second position) 43B) where the engagement with the driven side coupling 45 is released.

That is, in the rotation axial direction, the projected position (first position) 43A is where the developing drive side coupling 43 is engaged with the development driven side coupling 45 and the retracted position (second position) 43B is where it is retracted from the development driven side coupling 45. The contact spacing mechanism comprising the spacing members 48, 49 and the spring 47 translates the developing drive side coupling 43 between the projected position (first position) 43A and the retracted position (second position) 43B. The translating motion by the contact spacing mechanism (moving mechanism) is effected in interrelation with the opening and closing operation of the door 31 of the main assembly provided with the drive transmission mechanism.

When the cartridge not inserted, no coupling engagement exists, and therefore, the position of the driving shaft 42 of the developing drive side coupling 43 in the axial direction is such that it is abutted to the main assembly frame through the spacing members 48, 49 by the force of the spring 47.

In the developing drive side coupling 43 and the coupling gear 44 are rotatably engaged with the driving shaft 42. The developing drive side coupling 43 is movable in the axial direction of the driving shaft 42, and the rotation of the coupling gear 44 can be transmitted to the developing drive side coupling 43 through the drive transmitting portions 43*a*, 44*a*.

The structures of the drum driving unit (50) of the main assembly and the structures of the contact spacing mechanism relative to the drum driven side coupling 55 of the cartridge P are similar to those of the development driving unit 40. The drive transmission mechanism and the contact spacing mechanism of the development coupling and the photosensitive drum are mountable to the main assembly as one driving unit or assembly.

(Temporary Holding and Releasing Structure)

In the free state of the assembly of the driving unit 40, the spacing members 48, 49 do not abut the main assembly frame, and therefore, the developing drive side coupling 43 is projected by the spring 47. When the driving unit 40 is mounted to the main assembly of the apparatus, the projected developing drive side coupling 43 may hit a part of the main assembly of the apparatus with the result of reduction of the assembling property. If a cover or the like is additionally provided to prevent the projection of the developing drive side coupling 43, it will result in the increase in cost or upsizing of the main assembly of the apparatus.

In view of this, in this embodiment, as shown in FIGS. 11, 12, the developing drive side coupling 43 is provided with a temporary holding claw (first engaging portion) 43*d*. In addition, the coupling gear 44 is provided with a claw receiving surface (second engaging portion) 44*b*. Moreover, the developing drive side coupling member 43 is provided with a first operating portion (cam receiving surface 43*e*), and in the coupling gear 44 is provided with a second operating portion (cam surface 44*c*).

Figure 15:
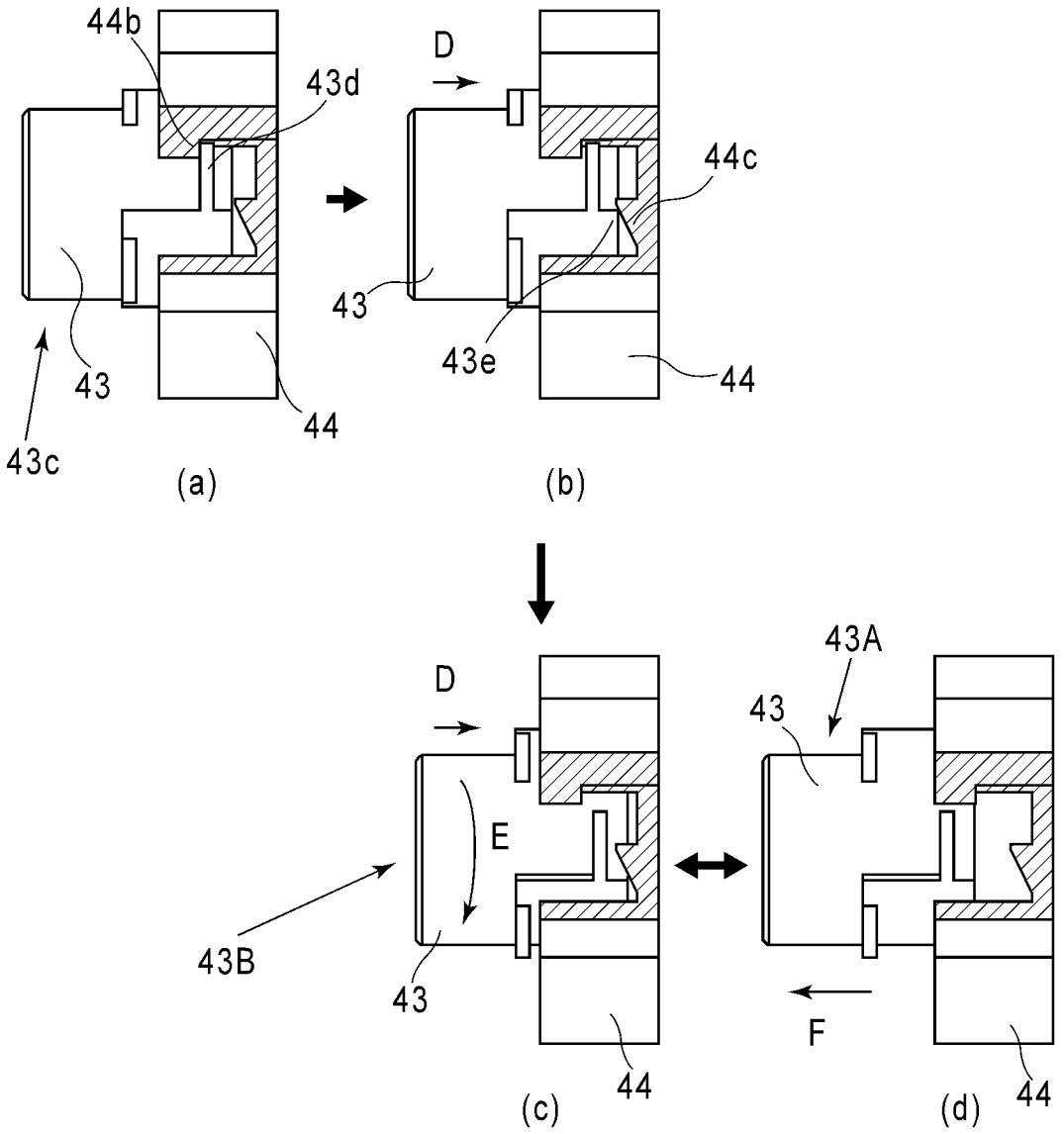
FIG. 15 is a sectional view illustrating an operation of temporary holding releasing mechanism.
Figure 16:
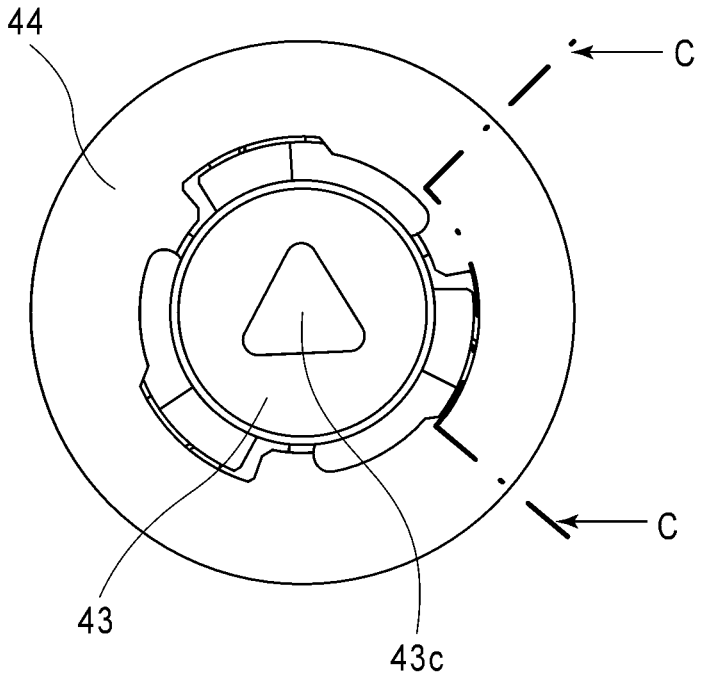
FIG. 16 is a sectional view of the device shown in FIG. 15.

FIG. 15 is a sectional view as seen in the direction C in the cross section shown in FIG. 16 to illustrate the temporary holding and releasing structures.

First, during the assembling of the driving unit 40, the temporary holding claw (first engaging portion) 43*d* and the claw receiving surface (second engaging portion) 44*b* are engaged with each other at a predetermined rotation angular position (first rotation angular position).

Then, the driving unit 40 is mounted to the main assembly 100 of the apparatus while the door 31 is kept open, and thereafter, the door 31 is closed. By doing so, the developing drive side coupling 43 moves to the retracted position (movement in the direction of an arrow D (part (b) of FIG. 15). However, during a movement, the cam surface 44*c* contacts the cam receiving surface 43*e* so that the cam receiving surface 43*e* slides on the cam surface 44*c*. By this, the developing drive side coupling 43 rotates in the direction indicated by an arrow E to such a position that the temporary holding claw 43*d* does not overlap the claw receiving surface 44*b* with respect to the axial direction. By this, the temporary holding claw 43*d* and the claw receiving surface 44*b* (first engaging portion and second engaging portion) are disengaged from each other. That is, the developing drive side coupling 43 rotates relative to the coupling gear 44 to such a position (second rotation angular position) that the temporary holding claw 43*d* and the claw receiving surface 44*b* cannot be engaged with each other.

Once they are disengaged, the developing drive side coupling 43 is movable only in the axial direction in the normal operations, and therefore, the temporary holding state does not occur even when the contacting and spacing operations are repeated (parts (c) and (d)). More particularly, when the developing drive side coupling 43 rotates to the second rotation angular position, the developing drive side coupling 43 is enabled to move to a projected position 43A by the contact spacing mechanism (spacing members 48, 49).

The temporary holding and release structures of the developing drive side coupling 43 which is the drive coupling member are summarized as follows.

The developing drive side coupling 43 and the coupling gear 44 as the holder member are provided with the temporary holding claw 43*d* and the claw receiving surface 44*b* as the first engaging portion and the second engaging portion, respectively, which are engaged with each other at the predetermined first rotational angular position. In addition, the developing drive side coupling 43 and the coupling gear 44 are provided with the cam receiving surface 43*e* and the cam surface 44*c* as the first operating portion and the second operating portion, respectively, which are actable on each other. The cam surface 44*c* is an inclined portion which is inclined relative to the rotational axis of the developing drive side coupling 43, and the cam receiving surface 43*e* slides on the cam surface 44*c*. When the temporary holding claw 43*d* and the claw receiving surface 44*b* are engaged with each other, the development drive side coupling 43 is held at the middle position (third position) 43*c* wherein it is engaged with the developing driven side coupling 45. This is the temporary holding state of the developing drive side coupling 43. Here, the middle position is a position between the projected position 43A and the retracted position 43B with respect to the rotational axis direction.

In the retracting operation of the developing drive side coupling 43 by the spacing members 48, 49, the developing drive side coupling 43 moves toward the coupling gear 44 so that the cam receiving surface 43*e* and the cam surface 44*c* are engaged to each other. And, the cam receiving surface 43*e* slides on the cam surface 44*c*. By this, the developing drive side coupling 43 rotates relative to the coupling gear 44 to such a position that the temporary holding claw 43*d* and the claw receiving surface 44*b* are not overlapped with each other. This state (the developing drive side coupling 43 has been moved to the second rotation angular position) is the temporary holding released state of the developing drive side coupling 43. In the temporary holding released state, the developing drive side coupling 43 is capable of moving to the projected position 43A.

The opening and closing operation of the door 31 is necessarily carried out during the assembling operation, for the purpose of insertion of the cartridge P into the main assembly 100 of the apparatus, for example, and therefore, it is unnecessary to manually release the developing drive side coupling 43. Therefore, there arises no such a trouble that the temporary holding releasing is inadvertently not carried out with the result of image defect.

The drive, the coupling member temporary holding and the release structures with the drum driving unit (50) of the main assembly relative to the drum driven side coupling 55 of the cartridge P are the same as with the development driving unit 40.

As described in the foregoing, according to the structures of the embodiments of the present invention, there are provided a coupling structure for the drive transmitting portion and an image forming apparatus having the same, with which the assembling property can be improved without additional cost increase.

[Others]

(a) the drive transmission mechanism according to the present invention is usable with the intermediary transfer belt unit 12 and the other drive transmission mechanism for various units and devices with the same advantageous effects.

(b) the cartridge P is not limited to a process cartridge of the above-described embodiment, which comprises an image bearing member on which a latent image is formed and a developing means for developing the latent image with a developer, as a unit.

The cartridge P may be a separable type process cartridge comprising a image bearing member on which a latent image is formed and an image forming process means other than such a developing means.

The cartridge P may be a developing cartridge comprising a developing means for developing a latent image formed on an image bearing member and a developer accommodating portion for accommodating a developer to be used for developing the latent image.

In such a case, the cartridge supported on the tray 35 is a pair of the separable type process cartridge and the developing cartridge (combination). Alternatively, at least one of the process cartridge and the developing cartridge may be supported dismountably relative to the tray 35.

The cartridge includes a unit which is contributable to the image forming process for forming a image on a recording material and which is detachably mountable to the main assembly of the apparatus.

(c) in the foregoing embodiments, the full-color electrophotographic image forming apparatus is taken as an exemplary example, to which four cartridges containing different color developers are detachably mountable. However, the number of the cartridges mountable to the apparatus is not limited to this, and the number may be properly selected by one skilled in the art. For example, the number may be one, two, three or not less than five. The present invention is applicable to a monochromatic image forming apparatus using only one cartridge.

(d) in the foregoing embodiments, the tray 35 is movable linearly in the horizontal direction. However, the tray (cartridge supporting member) 35 is not limited to such an example. For example, the tray 35 may be moved in a linear direction inclined from the horizontal direction and crossing with the studio direction of the drum, and the inclination may be ascending or descending. The tray 35 may be such that it can be dismounted from the main assembly of the apparatus by releasing from a stopper.

(e) in the image forming apparatus 100 of the foregoing embodiments, the intermediary transfer unit 12 may be replaced with a recording material feeding transfer belt device which carries the sheet S. More particularly, in such a case, the recording material feeding transfer belt device (recording material feeding transferring means) includes a recording material feeding member for feeding the sheet S to cause the sheet S to directly receive the developed image from the drum.

(f) the image forming apparatus is not limited to the printer as described in the foregoing. For example, it may be a copying machine, a facsimile machine or another image forming apparatus, or a multifunction machine or the like having the functions of such machines.

(g) the image forming process of the image forming apparatus is not limited to the electrophotographic process. For example, it may be an electrostatic recording process using a dielectric member for electrostatic recording as the image bearing member, a magnetic recording process using a magnetic member for magnetic recording as the image bearing member.

According to the foregoing embodiments, the driving side coupling member and the holder member are provided with respective claw portions (temporary holding mechanism) which are engageable with each other at the predetermined rotation angular position, and therefore, the pop out of the coupling member is prevented so that the assembling property is improved without significant increase in cost.

In the retracting operation by the contact spacing mechanism, the temporary holding state of the claw portions (temporary holding mechanism) is released.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 255915/2013 filed Dec. 11, 2013, which is hereby incorporated by reference.

What is claimed is:

1. A drive transmission mechanism comprising:

a driving side coupling member for transmitting a rotational force; and a holder member for holding said driving side coupling member, said driving side coupling member being provided with a first engaging portion, said holder member being provided with a second engaging portion which is capable of engaging with said first engaging portion when said driving side coupling member is in a first rotation angular position relative to said holder member, said driving side coupling member being further provided with a first operating portion, said holder member being further provided with a second operating portion for rotating said driving side coupling member when contacting said first operating portion, said driving side coupling member being movable along a rotational axial direction thereof between (1) a projected position projected from said holder member, (2) a retracted position retracted toward said holder member and (3) a middle position between the projected position and the retracted position, wherein when said first engaging portion and said second engaging portion are engaged with each other, said driving side coupling member is held in the middle position to be prevented from moving from the middle position to the projected position, wherein when said driving side coupling member is moved from the middle position toward the retracted position, the first operating portion and the second operating portion contact each other so that said driving side coupling member rotates relative to said holder member to a second rotation angular position where said first engaging portion and said second engaging portion are disengaged from each other, and wherein by said driving side coupling member rotating from the first rotation angular position to the second rotation angular position, said driving side coupling member is enabled to move to the projected position.

2. A mechanism according to claim 1, further comprising an elastic member for urging said driving side coupling member from the retracted position to the projected position.

3. A mechanism according to claim 1, further comprising a moving mechanism for moving said driving side coupling member to the projected position and to the retracted position.

4. A mechanism according to claim 3, wherein said moving mechanism includes an elastic member for urging said driving side coupling member from the retracted position to the projected position, and a retracting member for retracting said driving side coupling member from the projected position to the retracted position against an urging force of said elastic member.

5. A mechanism according to claim 1, wherein one of said first operating portion and said second operating portion is provided with an inclined portion inclined relative to the rotational axis of said driving side coupling member, and the other of said first operating portion and said second operating portion slides on the inclined portion by which said driving side coupling member rotates relative to said holder member.

6. A mechanism according to claim 1, wherein said driving side coupling member is provided with a first transmitting portion, and wherein said holder member is provided with a second transmitting portion for transmitting the rotational force to said driving side coupling member through said first transmitting portion.

7. An image forming apparatus for forming an image on a recording material, said apparatus comprising:

a driving side coupling member for transmitting a rotational force; and a holder member for holding said driving side coupling member, said driving side coupling member being provided with a first engaging portion, said holder member being provided with a second engaging portion which is capable of engaging with said first engaging portion when said driving side coupling member is in a first rotation angular position relative to said holder member, said driving side coupling member being further provided with a first operating portion, said holder member being further provided with a second operating portion for rotating said driving side coupling member when contacting said first operating portion, said driving side coupling member being movable along a rotational axial direction thereof between (1) a projected position projected from said holder member, (2) a retracted position retracted toward said holder member and (3) a middle position between the projected position and the retracted position, wherein when said first engaging portion and said second engaging portion are engaged with each other, said driving side coupling member is held in the middle position to be prevented from moving from the middle position to the projected position, wherein when said driving side coupling member is moved from the middle position toward the retracted position, the first operating portion and the second operating portion contact each other so that said driving side coupling member rotates relative to said holder member to a second rotation angular position where said first engaging portion and said second engaging portion are disengaged from each other, and wherein by said driving side coupling member rotating from the first rotation angular position to the second rotation angular position, said driving side coupling member is enabled to move to the projected position.

8. An apparatus according to claim 7, further comprising an elastic member for urging said driving side coupling member from the retracted position to the projected position.

9. An apparatus according to claim 7, further comprising a moving mechanism for moving said driving side coupling member to the projected position and to the retracted position.

10. An apparatus according to claim 9, wherein said moving mechanism includes an elastic member for urging said driving side coupling member from the retracted position to the projected position, and a retracting member for retracting said driving side coupling member from the projected position to the retracted position against an urging force of said elastic member.

11. An apparatus according to claim 7, wherein one of said first operating portion and said second operating portion is provided with an inclined portion inclined relative to the rotational axis of said driving side coupling member, and the other of said first operating portion and said second operating portion slides on the inclined portion by which said driving side coupling member rotates relative to said holder member.

12. An apparatus according to claim 7, wherein said driving side coupling member is provided with a first transmitting portion, and wherein said holder member is provided with a second transmitting portion for transmitting the rotational force to said driving side coupling member through said first transmitting portion.

13. An apparatus according to claim 7, further comprising a driven side coupling member for receiving the rotational force from said driving side coupling member by engagement with said driving side coupling member.

14. An apparatus according to claim 13, further comprising a main assembly provided with said driving side coupling member, and a cartridge detachably mountable to said main assembly and provided with said driven side coupling member.

15. An apparatus according to claim 14, wherein said cartridge includes a developing roller which is rotatable by said driving side coupling member transmitting the rotational force to said driven side coupling member.

16. An apparatus according to claim 14, wherein said cartridge includes a rotatable image bearing member on which a latent image is formed, and wherein said image bearing member is rotatable by said driving side coupling member transmitting the rotational force to said driven side coupling member.

17. An apparatus according to claim 14, wherein said cartridge includes a developing roller and an image bearing member on which a latent image is formed, and wherein at least one of said image bearing member and said developing roller is rotated by said driving side coupling member transmitting the rotational force to said driven side coupling member.

18. An apparatus according to claim 16, wherein said image bearing member is a photosensitive member.

19. An apparatus according to claim 7, further comprising an openable member for opening and closing an opening thereof, wherein said driving side coupling member is movable between the projected position and the retracted position in interrelation with said openable member.

* * * * *